United States Patent [19]

Hathaway et al.

[11] 4,140,228

[45] Feb. 20, 1979

[54] DRY PISTON COAL FEEDER

[75] Inventors: Thomas J. Hathaway, Belle Meade; Harold S. Bell, Jr., Madison, both of N.J.

[73] Assignee: The United States of America as represented by the United States Department of Energy, Washington, D.C.

[21] Appl. No.: 856,368

[22] Filed: Dec. 1, 1977

[51] Int. Cl.[2] ..... C10J 3/30

[52] U.S. Cl. ..... 214/35 R; 214/17 B; 214/152

[58] Field of Search ..... 214/17 B, 17 C, 18 R, 214/23, 35, 152; 48/86 R

[56] References Cited

U.S. PATENT DOCUMENTS 1,396,859 11/1921 Long ..... 214/17 B

FOREIGN PATENT DOCUMENTS 675864 5/1939 Fed. Rep. of Germany ..... 214/17 B

*Primary Examiner*—Robert G. Sheridan

*Attorney, Agent, or Firm*—Dean E. Carlson; Leonard Belkin

[57] ABSTRACT

This invention provides a solids feeder for feeding dry coal to a pressurized gasifier at elevated temperatures substantially without losing gas from the gasifier by providing a lock having a double-acting piston that feeds the coals into the gasifier, traps the gas from escaping, and expels the trapped gas back into the gasifier.

6 Claims, 4 Drawing Figures

LOAD MODE

PISTON 43
PISTON 45
ATMOSPHERIC VENT
COAL FEED BIN
VENT CONTROL VALVE
VENT
VENT

DELIVERY MODE

DRY PISTON COAL FEEDER

STATEMENT OF GOVERNMENT INTEREST

This invention was made in the course of or under a contract with the U.S. Energy Research and Development Administration.

CROSS-REFERENCE TO RELATED APPLICATIONS

Dry piston Coal Feeder
Hathaway, Bell
Ser. No. 856,367 filed Dec. 1, 1977
Filed concurrently herewith assigned to the assignee hereof.

BACKGROUND OF THE INVENTION

In the field of coal gasification it is advantageous to feed coal into a high temperature gasifier at pressures up to 100 atmospheres or more. One system used heretofore is to use a slurry feeder. However, these feeders required a slurry, which was dirty or difficult to handle, or they are were otherwise troublesome or hard to operate effectively. To overcome these problems it was proposed to use lock-hoppers, but these systems were inefficient heretofore, since the loading operation caused the lock-hoppers to fill with high pressure gas when the coal was dumped, and then to be released to the ambient atmosphere every time the hoppers were opened for refilling. Additionally, they were expensive to build and operate since they required expensive seals, which were subject to rapid wear and/or replacement because they were subject to abrasion from the solid passing through the lock-hopper.

SUMMARY OF THE INVENTION

This invention overcomes the above mentioned problems and deficiencies by providing a lock having a double-acting piston that feeds the coal into the high pressure gasifier, traps the high pressure gas from escaping, and expels the trapped gas into the gasifier. To this end, the lock is selectively closed to the ambient when the coal is dumped from the lock into the gasifier, and the lock is selectively closed to the gasifier when the coal is loaded into the lock by double acting pistons. In one cycle the double-acting pistons form a space that carries the coal volume in a first direction from an input bin at ambient low pressure to a coal discharge port at high pressure while substantially preventing the leakage of high pressure gas from the gasifier to the ambient along the outside of the pistons. When the coal is dumped, it is displaced by a small volume of high pressure gas that is trapped in the space between the pistons during the loading of the coal into the gasifier, and this gas is expelled back into the gasifier before the pistons are repositioned for refilling more coal therebetween. In this latter step, the pistons are repositioned with increased space there between by biasing them in the opposite direction under the coal feed bin for the beginning of a new cycle. More particularly, in one embodiment this invention provides a lock apparatus and method for cyclically feeding dry coal into a pressurized gasifier at elevated temperatures substantially without losing large amounts of the high pressure gas therefrom during the loading cycle, comprising loading coal into the space between two relatively moveable double acting pistons in a lock that substantially prevents leakage of the high pressure gas from the gasifier to the ambient through the lock, simultaneously holding the pistons in spaced apart relation while biasing them to dump the coal into the gasifier so as to displace the coal volume with a corresponding volume of high pressure gas that is trapped in the space between the pistons and substantially prevented from leaking to the ambient through the lock, relatively biasing the pistons toward each other to expel the high pressure gas volume in the lock back into the gasifier by reducing the space between the pistons through the lock, while substantially preventing the leakage of high pressure gas from the gasifier to the ambient and repositioning the pistons with increased space there between for the beginning of a new cycle in which more coal is loaded into the space between the pistons while substantially preventing the leakage of high pressure gas from the gasifiers to the ambient through the lock.

OBJECTS OF THE INVENTION

It is an object of this invention, therefore, to feed dry coal from a low pressure ambient to a pressurized gasifier at elevated temperatures substantially without losing gas from the gasifier to the ambient.

It is another object to provide an efficient lock apparatus and method for feeding dry coal into a high pressure reactor;

It is a still further object to provide a system of double acting pistons for feeding coal into a high pressure reactor.

BRIEF DESCRIPTION OF THE DRAWINGS

In the drawings where like elements are referenced alike.

DESCRIPTION OF THE PREFERRED EMBODIMENT

This invention is useful for efficiently feeding dry coal from a low pressure ambient into a high temperature pressurized gasifier at pressures up to 100 atmospheres or more substantially without losing gas from the gasifier. However, this invention is useful in any application where it is desireable to feed solids from a low pressure ambient into a high pressure container substantially without losing gas from the high pressure container.

Figure 1:
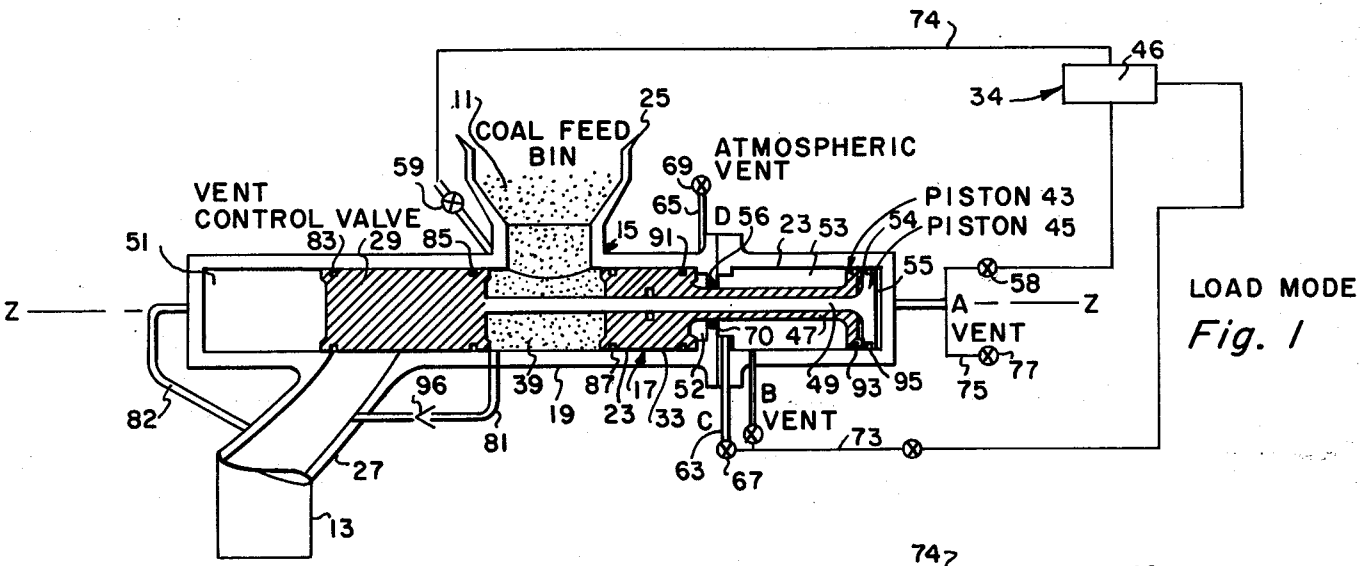
FIG. 1 is a partial cross section of one embodiment of the double acting pistons of this invention during one stage of their cycle during which coal is loaded from a low pressure ambient into the space between the pistons.
Figure 2:
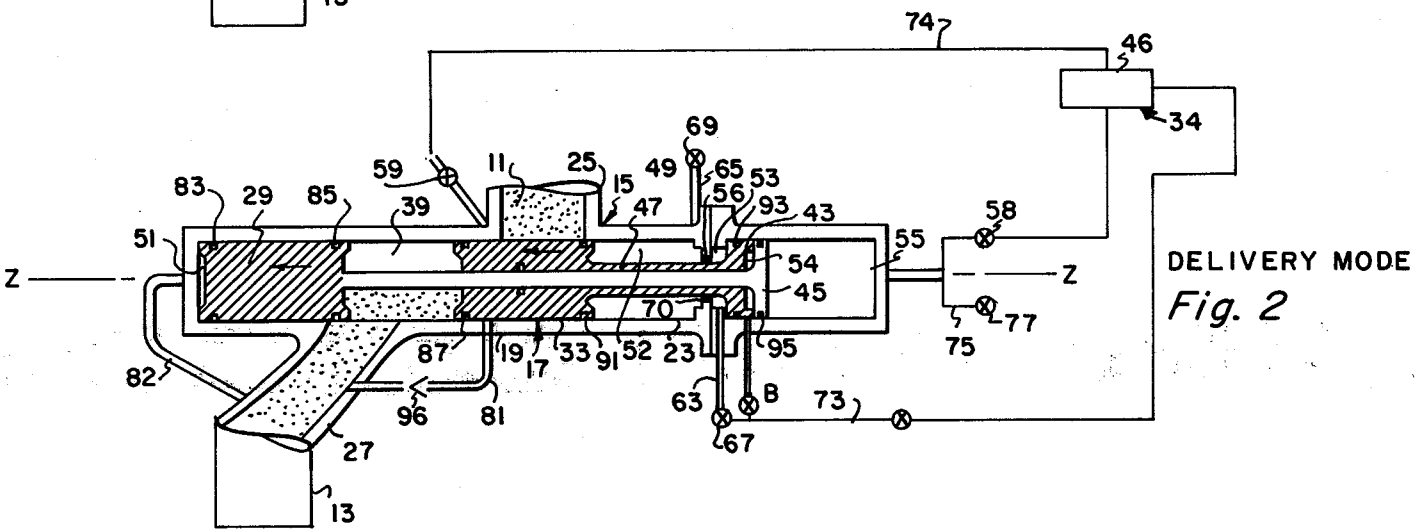
FIG. 2 is another view of the apparatus of FIG. 1 in the stage for dumping coal into a gasifier and trapping gas from escaping therefrom.
Figure 3:
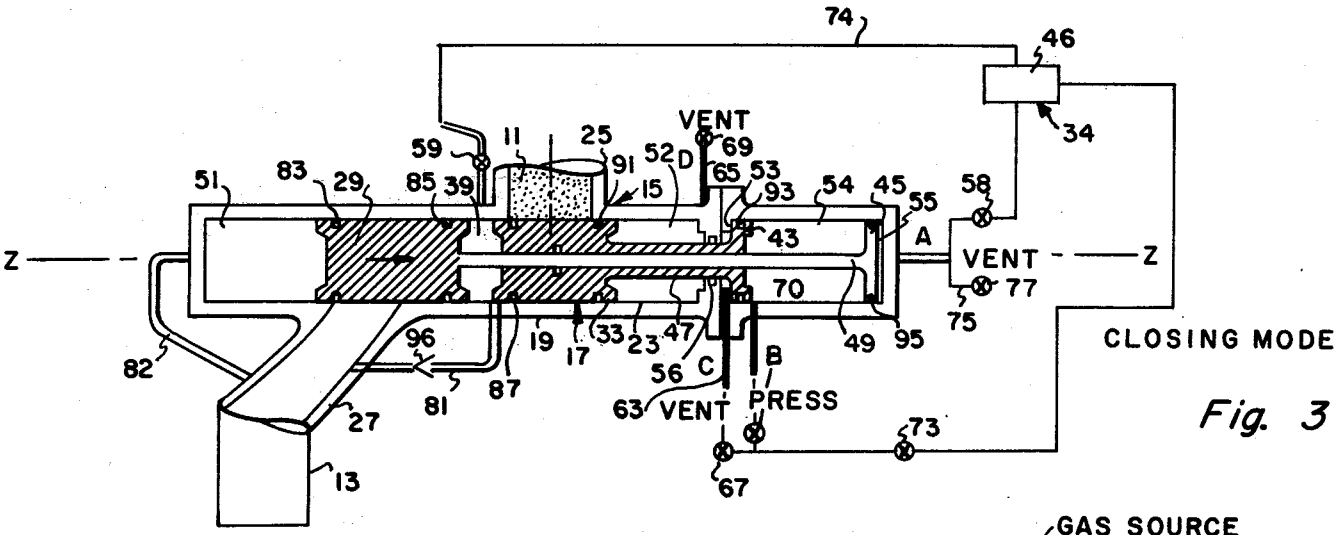
FIG. 3 is another view of the apparatus of FIG. 1 in its gas expelling stage wherein the space between the pistons is reduced to expel the trapped high pressure gas back into the gasifier.
Figure 4:
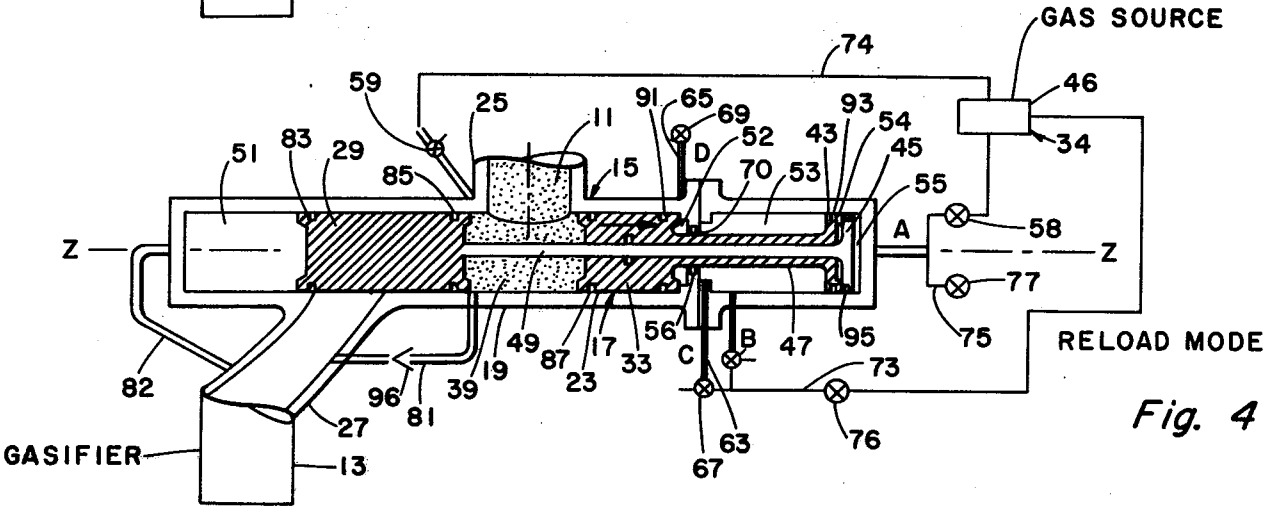
FIG. 4 is another view of the apparatus of FIG. 1 in the stage where the pistons thereof are repositioned with an increased space there between for receiving coal at the beginning of a new cycle.

Referring now to FIG. 1, it is known that coal 11 can be fed from a low pressure ambient into a conventional gasifier 13 for producing char and fuel gas at the bottom of the gasifier. To this end, for example, lock-hoppers have been used heretofore to feed the coal into a gasifier when the coal mixes with suitable reactants, such as pressurized hydrogen at high temperatures, and fuel gas and char produced are separated by conventional means well-known in the art. Heretofore, the lock-hoppers have been inefficient since they released high pressure gas everytime they were opened to fill them with more fuel.

Should dry coal 11 be fed into the gasifier 13 from a lock 15 having a double-acting piston 17, the latter, traps the gas from escaping and expels the trapped gas therefrom back into the gasifier. In accordance with this invention, the system is advantageous, since it doesn't waste energy everytime the coal is fed into the gasifier.

FIGS. 1–4 illustrate one cycle for feeding dry coal 11 into the pressurized gasifier 13 at elevated temperatures substantially without losing pressure and/or gas from the gasifier to the ambient through the lock 15. To this end, the lock 15 has a longitudinally extending cylindrical transport tube means 19 having an inside sealing surface 23 concentric with a first axis z—z, low pressure ambient input coal feed bin 25 connected to the tube means 19 at one end thereof, and a high pressure coal discharge port 27 connected between the gasifier and the tube means at the opposite end thereof from the coal feed bin.

The double-acting piston means 17, comprises a first piston 29 and a second piston 33 that ride inside the tube means 19 along the z—z axis in sealing contact with the sealing surface 23 of the tube means for receiving and transporting a volume of coal along the z—z axis from the feed bin 25 to the discharge port 27 to dump the coal into the gasifier in a first direction, to receive the high pressure gas in the opposite direction, to trap the gas from escaping, and to expel the trapped gas back into the gasifier in the first direction, while substantially preventing the leakage of any of the high pressure gas from the gasifier to the ambient through the lock.

The means 34 for relatively biasing the pistons 29 and 33 toward and away from each other to feed the coal into the gasifier, to trap the gas from escaping therefrom, and to expel the high pressure gas volume from the space 39 between the pistons back into the gasifier in the direction the coal was dumped therein, comprises the first set of pistons, a second set of pistons 43 and 45 that are relatively moveable in the transport tube means in sealing contact with the sealing surface 23 thereof, and pressure source means 46 for selectively actuating both sets of pistons selectively to bias them relatively together and apart. To this end, the second set of pistons are connected to the first set of pistons by shafts 47 and 49 respectively, and the respective chambers 51, 52, 53, 54 and 55 are suitably pressurized or vented through suitable vents and valves, while seal 56 separates the first and second set of pistons. The other elements involved, comprise valves B, 58, 59, 67, 69, and vent 65, as well as partition 70, pressure lines 73 and 63, vent 75 and valve 77, equalization lines, 81 and 82, as well as check valve 96, and seals 83, 85, 87, 91, 93 and 95. Auxiliary line 74 is only used to blow coal out of space 39, if desired.

In one sequence, starting with FIG. 1, chamber 55 is pressurized from source 46 through valve 58 while vent valve 77 is closed and three way valve 67 is in a venting position. This moves all the pistons to the left into the position shown in FIG. 2 to dump the loaded coal into the gasifier. This returns the high pressure gas through line 82 and pressurizes space 39.

In the next step, chamber 54 is pressurized from source 46 through valve B, while valve 77 opens and valve 58 closes. Thus, the second pistons separate and the first pistons come together. This reduces the size of space 39 so that the high pressure gas trapped therein returns to the gasifier through line 81 and check valve 96, and the pistons take up the position shown in FIG. 3.

In the next step, chamber 53 is pressurized from source 46 through valves 67 and 76 and line 73, while valves B and 58 are closed and vent valves 77 and 69 are open to vent chamber 52 through line 65 and chamber 55 through line 75. This returns the pistons to the loading position shown in FIGS. 4 and 1, which illustrate seals 83, 85, 87 and 91 on the first set of pistons and seals 93 and 95 on the second set of pistons in contact with the inside sealing surface 23 of the cylindrical tube means 19 to form lock 15, which is alternately connected to the feed bin and the gasifier and which always seals off the feed bin from the gasifier.

In operation, the space 39 is loaded with a volume of dry coal that is advantageously powdered for feeding to the high-temperature, high-pressure gasifier at up to 100 atmospheres pressure or more and at a temperature of up to 800° C. or more to produce char and fuel gas which are removed from the bottom of the gasifier 13. However, virtually any kind of coal or other solid of substantially any size can be used.

This invention has the advantage of efficiently feeding coal into a high pressure, high temperature gasifier substantially without losing gas or pressure from the gasifier by using double-acting pistons that feed the coal into the gasifier from a closed lock that traps high pressure gas from escaping the lock, expelling the trapped gas back into the gasifier, and that are selectively respositioned selectively to open the lock for the beginning of a new cycle while substantially preventing the leakage of the high pressure gas from the gasifier to the ambient along the outside of the pistons.

This invention also has the advantage that it provides single malfunction safety protection in case of failure of any single actuation system component. To this end, the coal bin is always sealed off from the gasifier.

This invention has the additional advantage that it can feed all types of coal and any size required.

A still further advantage is that the coal is not physically or chemically altered, e.g. by crushing, compacting, agglomeration or devolatilization.

What is claimed is:

1. Locking apparatus for cyclically feeding dry coal into a pressurized gasifier at elevated temperatures, comprising:

a. longitudinally extending cylindrical transport tube means having and inside sealing surface for receiving and transporting coal along an axis into the pressurized gasifier at elevated temperatures;

b. a low pressure ambient input coal feed bin connected to one end of said cylindrical transport means;

c. a high pressure coal discharge port connected between the gasifier and the cylindrical transport means at the opposite end thereof from the coal feed bin;

d. relatively moveable, double-acting, piston means riding in the cylindrical transport means having first and second piston means in sealing contact with the inside sealing surface thereof for receiving and selectively transporting a volume of coal from the feed bin along said axis to the discharge port to dump the coal into the gasifier and to displace the coal volume with a corresponding volume of high pressure gas that is trapped in the space between the pistons while substantially preventing the leakage of high pressure gas from the gasifier to the ambient along the outside of the pistons;

e. means for relatively, biasing said pistons toward each other to expel the high pressure gas volume from the space between the pistons back into the gasifier while substantially preventing the leakage of high pressure gas from the gasifier to the ambient through the lock;

f. means for biasing said pistons while they are together toward the feed bin while substantially preventing the leakage of high pressure gas from the gasifier to the ambient through the lock; and g. means for relatively biasing the pistons apart to open the space between the pistons to communicate the same with the low pressure ambient while substantially preventing the leakage of high pressure gas from the gasifier to the ambient through the lock for the beginning of a new cycle in which the space between the piston means is filled with more coal.

2. The apparatus of claim 1 in which the second piston means has a shaft that extends longitudinally to form a third piston means in the cylindrical means at one end of the cylindrical means, and the first piston means has a rod that extends longitudinally through the second and third piston means and the first shaft to form a fourth piston means in the cylindrical means that is selectively and relatively moveable relative to the third piston means so that the fourth piston means can be pressurized to move both the first and second piston means away from the coal feed bin toward the coal discharge port to discharge coal from the space between the pistons into the coal discharge port so as to displace the coal with a high pressure gas volume from the gasifier while the second piston means closes the coal feed bin from communication with the cylindrical transport means, the fourth piston means having biasing means for moving it away from the third piston means to move the first and the second piston means together again to expel the high pressure gas volume back into the gasifier while the first piston means closes the coal discharge port in the cylindrical transport means between the coal discharge port and the coal feed bin, and said third piston means having biasing means for moving it toward the fourth piston means to open the space between the first and second piston means for receiving ambient low pressure air and replacing it with coal for the beginning of a new cycle.

3. The apparatus of claim 2 in which the biasing means has means for venting one side of the third piston means, and means for selectively pressurizing the space between the fourth piston means and the one end of the cylindrical means when the first and second piston means are in spaced apart relation for moving both the first and second piston means away from the coal feed bin for dumping the coal between those piston means while maintaining the space therebetween for pressurizing that space with high pressure gas volume while said second piston means closes the coal feed bin from communication with the cylindrical means.

4. The apparatus of claim 3 in which said biasing means pressurizes the space between the third and fourth piston means for relatively moving the fourth piston means away from said third piston means for biasing the first piston means to expel the high pressure gas volume into the gasifier while closing the discharge port.

5. The apparatus of claim 4 in which said biasing means has means for pressurizing the space between the third piston means and the one end of the cylindrical means for biasing the second piston means toward the other end of the cylindrical means to open the space between the first and second pistons to the ambient for the beginning of a new cycle in which said space is sequentially filled with ambient air and then the air is displaced by coal.

6. The method of feeding dry coal from a low pressure ambient into a pressurized gasifier at elevated temperatures, comprising the steps of:

a. cyclically loading coal from a low pressure ambient into the space in a lock between two relatively moveable double acting pistons while substantially preventing leakage of the high pressure gas from the gasifier to the ambient along the outsides of the pistons;

b. simultaneously holding the pistons in spaced apart relation while biasing them in a first direction in the lock to dump the coal into the gasifier so as to displace the coal volume with a corresponding volume of high pressure gas that is trapped in the space in the lock while substantially preventing the leakage of high pressure gas from the lock;

c. relatively moving the pistons toward each other to expel the high pressure gas volume back into the gasifier in the first direction by reducing the space between the pistons while substantially preventing the leakage of high pressure gas from the gasifier to the ambient along the outsides of the pistons; and d. repositioning the pistons with increased space therebetween for the beginning of a new cycle in which more coal is loaded into the space while substantially preventing the leakage of high pressure gas from the gasifier to the ambient along the outsides of the pistons.

* * * * *